United States Patent [19]

MacMaster et al.

[11] 3,941,968

[45] Mar. 2, 1976

[54] MICROWAVE BROWNING PLATE

[75] Inventors: George H. MacMaster, Lexington; Kenneth W. Dudley, Sudbury, both of Mass.

[73] Assignee: Raytheon Company, Lexington, Mass.

[22] Filed: Mar. 27, 1975

[21] Appl. No.: 562,745

[52] U.S. Cl. ..... 219/10.55 E; 99/DIG. 14

[51] Int. Cl.[2] ..... H05B 9/06

[58] Field of Search.....219/10.55 E, 10.55 F, 10.55 M; 99/451, DIG. 14

[56] References Cited

UNITED STATES PATENTS

| | | | |
|---|---|---|---|
| 3,230,864 | 1/1966 | Krajewski | 99/DIG. 14 |
| 3,591,751 | 7/1971 | Goltsos | 219/10.55 E |
| 3,662,141 | 5/1972 | Schauer, Jr. | 219/10.55 E |
| 3,701,872 | 10/1972 | Levinson | 219/10.55 E |
| 3,809,845 | 5/1974 | Stenstrom | 99/451 X |
| 3,845,266 | 10/1974 | Derby | 219/10.55 E |
| 3,857,009 | 12/1974 | MacMaster et al. | 219/10.55 E |
| 3,878,350 | 4/1975 | Takagi | 219/10.55 E |
| 3,881,027 | 4/1975 | Levinson | 219/10.55 E |

FOREIGN PATENTS OR APPLICATIONS

| | | | |
|---|---|---|---|
| 1,596,475 | 7/1970 | France | 99/DIG. 14 |
| 7,004,169 | 9/1970 | Netherlands | 219/10.55 E |

*Primary Examiner*—Arthur T. Grimley
*Attorney, Agent, or Firm*—Edgar O. Rost; Milton D. Bartlett; Joseph D. Pannone

[57] ABSTRACT

A microwave browning plate utilizing members of a relatively low dielectric constant material is provided having a conductive coating on three sides with a load supported on the uncoated side. The induced currents in the conductive material provides for current induced in the dielectric material. An exponentially decreasing fringing electric field is provided as a standing wave adjacent to the uncoated side. A low dielectric constant material may be utilized with the conductive coating and an overall height of one-quarter of a wavelength will result in a thinner microwave plate. Means are provided for restricting the current flow to a desired mode.

2 Claims, 3 Drawing Figures

FIG. 1
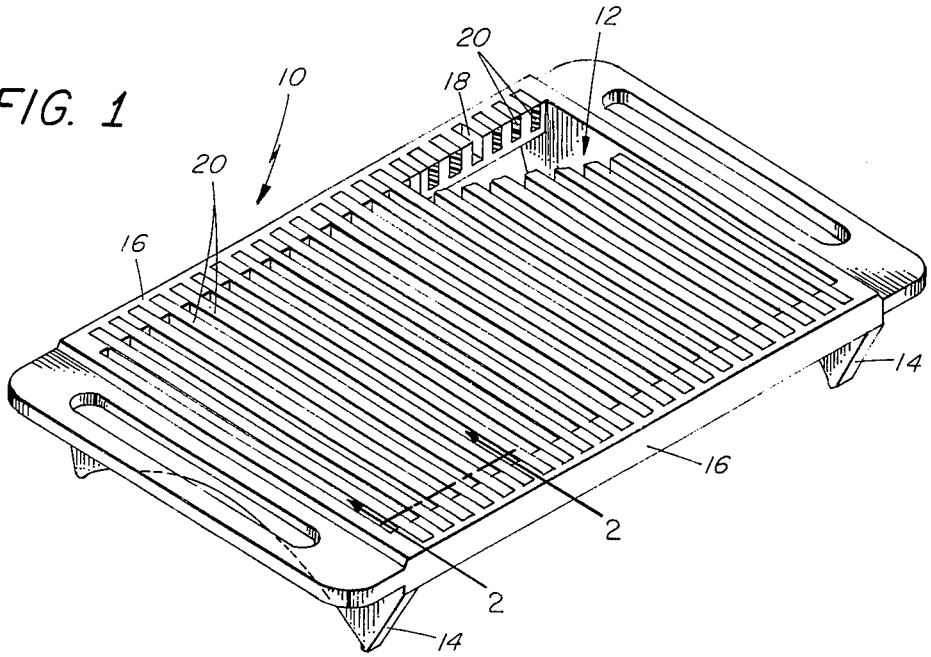
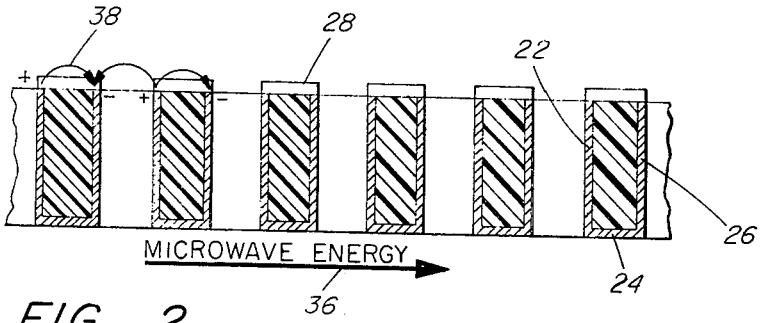
FIG. 2
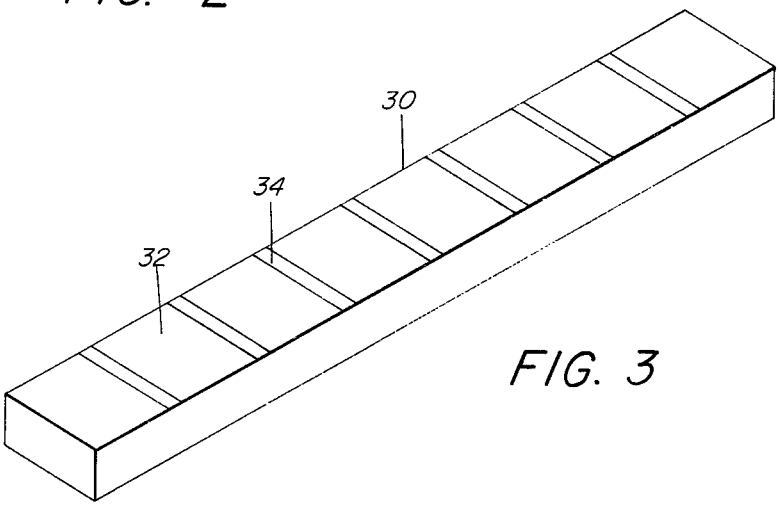
FIG. 3

MICROWAVE BROWNING PLATE

BACKGROUND OF THE INVENTION

1. Field of the Invention

The invention relates to microwave heating and a utensil for producing browned and seared surfaces.

2. Description of the Prior Art

Microwave heating has become widely accepted for the preparation of a number of products. The microwave frequency energy is radiated within an enclosure from an energy source, such as a magnetron. The waves are radiated and reflected within the enclosure in free space and are distributed by such means as mode stirrers and the like. The microwave energy sets up a high frequency oscillatory movement of the molecules in a load to cause heating by molecular friction. The term "microwaves" is defined as electromagnetic energy radiation having wavelengths in the order of one meter to one millimeter and frequencies in excess of 300 MHz. Materials heated by microwave radiation have differing dielectric constant and loss tangent characteristics which result in heating in a varying pattern. As a result the varying absorption of the radiated energy causes the depth of penetration and surface coloration of the load to vary. It is difficult, therefore, to achieve a browned or seared surface similar to that produced by broiling without long periods of exposure which results in overcooking of the interior regions. Prior art techniques for browning include the incorporation of electric or gas broiling elements in the microwave oven. Another method involves the coating of the outer surface with a food additive having a high energy absorption characteristic. Another example of prior art teachings involves the use of lossy ovenware or utensils having selective heating capability by means of the use of conductive materials. Such conductive materials become heated from the absorbed energy and transfer this heat thermally to the supported load.

Still another example of prior art teaching is the utensil described in U.S. Pat. No. 3,857,009 issued Dec. 24, 1974 to G. MacMaster et al and assigned to the assignee of the present invention. This structure incorporates a load supporting means for converting and transforming the free-space energy waves into a finging electric field pattern having 180° phase differential in close proximity to the exterior surfaces of the load. The means for converting and transforming the planar energy comprise alternating regions of high and low dielectric constant material. Providing high dielectric constant materials, such as those having a value of K38 or K50, tends to be costly. In addition in the patented structure an overall height of approximately one-half wavelength is required to arrive at the 180° phase differential between the ends of adjacent elements. Further, in the patented structure the waves are directed through the dielectric material in varying degress to evolve the 180° phase differential pattern. A continuing need exists for a microwave browning utensil which is relatively thin, lightweight and easy to clean.

SUMMARY OF THE INVENTION

In accordance with the teachings of the present invention a microwave browning utensil is provided having a plurality of dielectric members one-quarter wavelength in height supported by a body or holding member. The dielectric members may be of a low or moderately high dielectric material such as a material having a dielectric constant of 9 or, alternatively, a material having a dielectric constant value of 38. The dielectric members are arranged in an array with an intervening space between the members. A conductive material is disposed on three sides of the dielectric members which may be of a rectangular or square configuration.

The conductive coating supports the currents which are induced along the surfaces as well as within the dielectric material itself. The current flow and phase delay introduced by the dielectric material creates a 180° phase differential to result in the intense fringing fields adjacent the load supporting surface of the dielectric members.

In an illustrative embodiment a utensil is provided having legs to raise the load to be heated from the bottom wall of the oven enclosure to permit the free-space waves bouncing from the bottom wall to penetrate the load. The free-space waves from the bottom wall impinge on the conductive coating to induce the current flow terminating in a free end of the metallized members and give rise to the fringing field pattern adjacent to the load. The induced currents along the conductive layer also result in the injection within the dielectric members of the electromagnetic energy and the propagation through the dielectric members provides the 180° phase shift to evolve the fringing heating pattern.

The $\pi$ mode fringing electric field is of the standing wave type and for most efficient operation the TEM mode is desirably suppressed to prevent the excitation of modes other than the $\pi$ mode. Such propagating waves would be propagated along the conductive layers formed on adjacent walls of the dielectric bar members. The mode damping slots are provided on parallel sides which face one another. The damping of the current flow in the TEM mode enhances the energy available in the fringing field to result in additional searing with improved uniformity.

BRIEF DESCRIPTION OF THE DRAWINGS

Details of the invention will be readily understood after consideration of the following description of an illustrative embodiment and reference to the accompanying drawings, wherein:

FIG. 1 is an isometric view of the illustrative embodiment of the invention;

FIG. 2 is a cross-sectional view of a portion of the embodiment shown in FIG. 1 taken along the line 2—2; and FIG. 3 is an isometric view of a metallized dielectric bar member having mode damping slots.

DESCRIPTION OF THE PREFERRED EMBODIMENT

The microwave browning utensil 10 comprises a recessed main body portion 12. Leg portions 14 provide for supporting the utensil within a space for radiating microwaves reflected from the bottom wall of the microwave oven. The sides 16 of the body portion 12 are notched as at 18 to receive a plurality of rectangular bar members 20 which are positioned to span the main body portion and snugly engage the notches 18. The bar members are fabricated of any dielectric material such as epoxy loaded titanium dioxide having a dielectric constant value of, illustratively, 9. The conductive coating of a material such as copper is applied to sides 22, 24 and 26 as shown in FIG. 2 by a plating process such as electrolysis. The uncoated side 28 supports the articles to be heated and for ease in cleaning Teflon is applied to the nonmetallized surfaces 28.

In FIG. 2 the metallized bars are shown. Microwave energy from a source such as a magnetron is radiated within an enclosure. Since these components are believed to be well known, details have been omitted in the interest of clarity in understanding the invention. The microwave energy at a predetermined frequency such as 2450 MHz±50 MHz is represented by arrow 36 as a free space planar wave. The energy is converted by the bar members 20 into a fringing electric field pattern designated by arrows 38 adjacent to the load. The bar members are approximately one-quarter of a guided wavelength in height at the microwave frequency. The wavelength λ is derived from the equation $$\lambda = \frac{c}{\sqrt{\Sigma f}}$$

where $c$ is the velocity of light, Σ is the dielectric constant and $f$ is the frequency. In an exemplary embodiment utilizing material having a dielectric constant value of 9 the height of the bar members was 0.306 inches. This dimension is a marked improvement over prior art one-half wavelength dimension of approximately 0.456 inch for dielectric constant material having a value of 38.

Referring to FIG. 3 a bar member 30 is illustrated having a conductive coating 32 along one planar side wall. The conductive walls of the bar member can support TEM modes which will result in nonunifom searing or browning of the meat. The energy in the TEM mode will cause overcooking at the ends of the meat and reduce the electric field strength in the desired $\pi$ mode. A series of slots or coating voids extending perpendicular to the direction of flow of the current in the TEM mode will prevent the propagation of power in this mode along the conductively coated bar members.

Since it is important that all the microwave energy entering the microwave plate be converted into the $\pi$ mode the distance between slots on the metallized side is less than one-half a wavelength at the operating frequency.

There is thus disclosed a utensil for uniformly browning and searing the surfaces of a load. Lower dielectric constant materials may be utilized with the one-quarter wavelength height dimension by means of the provision of a conductive layer on all sides of the dielectric member except the load supporting side. A thinner utensil results at a lower cost.

Numerous variations, modifications and alterations will be evident to those skilled in the art. The foregoing detailed description of an illustrative embodiment is, therefore, intended to be interpreted broadly.

We claim:

1. A utensil for heating with microwave energy at a predetermined frequency comprising:

a plurality of members of a low dielectric constant material having four parallel sides;

siad dielectric members having a height of approximately one-quarter of a guided wavelength of energy at said frequency propagated within the dielectric members;

a coating of a conductive material on three sides of said members;

means for supporting said members in a parallel array with intervening spaces and the uncoated sides exposed to receive a load to be heated; and said uncoated sides providing a fringing electric field in close proximity to the load when microwave energy is applied.

2. A utensil according to claim 1 wherein slots are provided in the conductive coating on sides of said dielectric members bounding said intervening spaces to suppress unwanted energy modes.

* * * * *